United States Patent [19]

Hinson et al.

[11] Patent Number: 4,914,752

[45] Date of Patent: Apr. 10, 1990

[54] TEMPERATURE-REGULATED GARMENT UTILIZING A VORTEX TUBE

[75] Inventors: Thomas L. Hinson, Dix Hills, N.Y.; William A. Blackburn, Chapel Hill, N.C.

[73] Assignee: Abandaco, Inc., Decatur, Ala.

[21] Appl. No.: 303,539

[22] Filed: Jan. 27, 1989

[51] Int. Cl.[4] ..... A41D 13/00

[52] U.S. Cl. ..... 2/2; 2/79; 2/81; 62/5

[58] Field of Search ..... 2/2, 81, 79, DIG. 1; 62/5

[56] References Cited

U.S. PATENT DOCUMENTS

| | | | |
|---|---|---|---|
| 3,291,126 | 12/1966 | Messick | 128/142.4 |
| 3,468,299 | 9/1969 | D'Amato | 2/81 |
| 3,630,039 | 12/1971 | Hayashi | 62/5 |
| 3,815,573 | 6/1974 | Marcus | 126/204 |
| 4,146,933 | 4/1979 | Jenkins et al. | 2/2 |
| 4,192,473 | 3/1980 | Melander | 2/2 |
| 4,240,261 | 12/1980 | Inglis | 62/5 |
| 4,271,833 | 6/1981 | Moretti | 128/201.29 |
| 4,558,466 | 12/1985 | Kristensson | 2/2 |
| 4,741,333 | 5/1988 | Susuki | 128/201.73 |

FOREIGN PATENT DOCUMENTS

| | | | |
|---|---|---|---|
| 2546759 | 12/1984 | France | 2/2 |

OTHER PUBLICATIONS

AEC Research and Development Report (DP-861) "Use of Vortex Tube For Cooling Weavers of Industrial Protective Clothing," Savannah River Lab., Aiken, S.C.

Vortec catalog excerpt.

*Primary Examiner*—H. Hampton Hunter

*Attorney, Agent, or Firm*—Lynn E. Barber

[57] ABSTRACT

The garment of the invention for receiving temperature regulated air from an external air source comprises an outer torso covering layer, a diffuser layer attached to the interior of the outer layer and a belt means for attachment of a vortex tube to an orifice in the garment outer layer.

12 Claims, 4 Drawing Sheets

TEMPERATURE-REGULATED GARMENT UTILIZING A VORTEX TUBE

BACKGROUND OF THE INVENTION

1. Field of the Invention

This invention relates to wearing apparel and more particularly to a suit of protective clothing having temperature controlled air under positive pressure in a diffuser area of the suit.

2. Description of the Related Art

Persons who work with toxic or noxious chemicals or in areas contaminated with airborne hazardous substances, such as farmers applying pesticides or cleanup or other workers in polluted environments must wear protective, nonpermeable, outer clothing that substantially encloses their bodies to shield them from these chemicals. These protective garments, whether nonporous or of limited porosity may become very warm under the working conditions, which are often in high temperature areas. Where the hazards are most severe and the required clothing must be very protective, workers may be unable to work at full efficiency for more than a short time without leaving the working area to cool off or without suffering heat-related health problems. Agricultural workers engaged in pesticide application or in handling other chemicals must generally remain in large, expensive protective and air-conditioned, air-filtered tractor cabs to be protected from chemicals if they are not to be overcome by the heat generated during working in a protective suit.

A variety of cooling garments and associated cooling systems have been developed in an attempt to solve this problem. One means that has been developed to cool a worker's body utilizes cooling packs or strips that are attached to or incorporated within a garment. The cooling packs add bulk to the garment and require pre-cooling of the packs and periodic changing of the packs but they do allow the garment to be portable.

Many other cooling systems are not portable and require long lengths of insulated hose between the cooling unit and the worker, particularly if the worker's job requires extensive mobility. Wherever the cooling mechanism relies on lengths of hose to carry the cooled air to the worker, the air in the hose may heat prior to reaching the person unless there is additional cumbersome, expensive insulation. Many portable units are also cumbersome and bulky for the worker to carry. In some cases, the cooling system may be attached to a mobile compressor. Thus, protective garmets have been attached to motorized vehicles to provide heated air from the heat of the engine (U.S. Pat. No. 4,146,933). The disclosure of this patent and all other cited patents is hereby incorporated herein by reference.

Other workers may need protective suits in severely cold weather and require a means of keeping both warm and free of hazardous substances.

Vortex tubes are used in a wide variety of cooling systems including protective clothing. They are generally lighter than a portable air conditioning unit, less expensive, and easier to regulate. In a vortex tube, high pressure air enters the inlet, and goes through a vortex generation chamber and into the hot-tube portion of the vortex tube. Under centrifugal force, the air spirals down the inside of the tube, going around the inside of the walls toward the hot end where some of the air escapes. The remaining air returns up the center of the tube, through the vortex generation chamber and out the cold outlet. A control valve at the hot end allows variation of the fraction of air that is cold and thus the coldness of the cold outlet.

Although vortex tubes have often caused problems by creating excess hot or cold air or excess noise, these problems have been overcome in currently marketed vortex tubes and associated protective mufflers and insulative materials. The temperature of air emitted from vortex tubes may be regulated in a variety of ways, for example by means of movable flow-dividing members as discussed in the patent of Inglis (U.S. Pat. No. 4,240,261), by means of a plurality of vortex tubes as in Shackson (U.S. Pat. No. 3,103,104) or by valves and a thermostat as in Green (U.S. Pat. No. 2.819.590).

Most temperature-regulated protective garments, including those utilizing vortex tubes, utilize some type of conduit for conducting the cooled or heated air to various places around the wearer's body. In the individual cooling unit of Hayashi (U.S. Pat. No. 3,630,039), air from a compressor goes through a pipe placed in a cooling tank for precooling and then to a vortex tube mounted on the person. Distributor pipes of unspecified construction are connected to the cold-air outlet of the vortex tube for diffusing air into the interior of the worker's clothes. In Messick's air cooling unit (U.S. Pat. No. 3,291,126), a vortex tube is connected to the air source. Cooled air is conducted by conduits from the vortex tube cooling end to the hand and leg areas. The conduits are closed on the ends and have outlet slots or slits along their sides for air release.

An air-conditioned vest that connects to a vortex tube but does not use inner garment conduits is sold by Vortec Corporation (Cincinnati, Ohio). This vest is generally worn under protective coveralls or suits. Air enters the double layer vest from a waist worn vortex tube and escapes from holes positioned in selected areas of the vest's lining over the wearer's clothing worn under the vest. The neck area is cooled by air from a separate hose that runs to a neck ring or a helmet.

Vortex tubes have also been used for heating garments, such as in the diving suit heater of Marcus (U.S. Pat. No. 3,815,573). Heated gas from the vortex tube is passed through a fluid-filled heat exchanger and the heated fluid is pumped through channels in a diving suit.

Garments not utilizing vortex tubes but relying on conduits to convey temperature-regulated air include those of Melander and Moretti. Melander's wearable ventilation system (U.S. Pat. No. 4,194,247), is worn under an outer protective garment. A manifold receives ventilating gas and supplies the gas to one or more manifold outlets that are each connected to flexible fabric gas distribution conduits having pin-size orifices. A head distribution tube may have enlarged orifices near the face area.

The ventilated system of Moretti (U.S. Pat. No. 4,271,833) includes a head enclosure and body suit of either permeable or impermeable material. Pressurized air is provided to each limb of the wearer and respiration air is provided to the head enclosure by means of a manifold having multiple air outlets. The manifold is strapped to the user's trunk and is connected to an air source. Air flow from the air source is regulated by the manifold as it flows through conduits to be released into diffuser means on each limb of the user. The diffusers each are made of two layers, one of which is non porous and the other of which is microporous material. Air goes through the pores and spreads over the wearer's limbs.

Temperature-regulated air from non-vortex tube sources may also be fed directly into garment areas on the person's arms, legs and head as in Jenkins. The conditioned-air suit of Jenkins (U.S. Pat. No. 4,146,933) has multiple places for connection of air-conditioning hose connections. Air from either an unspecified cold air source or a hot air source such as an engine is placed in the garment between the garment and the wearer's inner clothing down the arms and legs and into a lined hood area to insulate the wearer from ambient conditions. The air pressure causes some leakage of the air from the garment.

To keep toxic substances from entering a garment and to keep them away from the wearer's head, pressurized air may also be made to flow into the interior of a garment and out over the face area. The two-layered vest of Kristensson (U.S. Pat. No 4,558,466) has a lower area where both layers are impermeable and an upper area where the outer layer is air-permeable. Fresh air at an agreeable ambient temperature is introduced into the lower inner portion of the vest and flows upward and outward from the area between the vest layers. Kristensson does not utilize a vortex tube nor any other particular source of cooled or heated air.

Other ventilated garments that do not include attached gas sources may utilize flaps over air permeable fabrics or perforated panels and other ventilation openings (for example, U.S. Pat. Nos. 4,513,451, and 4,608,715). These garments do not provide continuous, regulated or evenly distributed ventilation nor is there reliable positive air pressure within the garment to keep out toxic substances.

Many protective suits require extensive cleaning efforts to make them reusable once they are contaminated. Cleaning of garments having complicated conduits for air may result in damage to or clogging of the conduits. The cost of many of these garments is often too great to make it cost effective to treat them as disposable. As cost decreases, the likelihood of the protective garments having effective temperature regulation systems also decreases, particularly since expensive conduits and other components of the temperature-regulation system may be built into the garment itself.

It is therefore an object of this invention to provide temperature-regulated protective garment that utilizes a vortex tube.

It is a further object of this invention to provide a type of temperature-regulated protective garment that may be used in chemically hazardous areas, including agricultural and industrial environments.

It is a further object of this invention to provide a type of temperature-regulated protective garment that improves worker efficiency and increases the amount of time a worker may work per day.

It is a further object of this invention to provide a type of temperature-regulated protective garment that is inexpensive enough to be used as a disposable garment in a cost effective manner but is designed to withstand repeated use and exposure to chemicals.

It is a further object of this invention to provide a temperature-regulated protective garment in which the more expensive components of the temperature regulation system are detachable from the garment.

It is a further object of this invention to provide a temperature-regulated protective garment that does not have complicated conduits or other internal flow mechanisms that are easily clogged or damaged in use or cleaning.

A further object of this invention is to provide a temperature-regulated protective garment that is close to the air temperature regulator.

A further object of this invention is to provide a temperature-regulated protective garment that may be attached to a variety of air sources, including a tractor-attached compressor.

Other objects and advantages will be more fully apparent from the following disclosure and appended claims.

SUMMARY OF THE INVENTION

The garment of the invention for receiving temperature-regulated air from an external air source comprises:

(a) an outer torso covering layer having an interior surface, an exterior surface, a neck area, a waist area, and an air orifice;

(b) a diffuser layer having peripheral edges, said edges attached to the interior surface of said outer covering layer, said diffuser layer being made of a diffuser fabric; and (c) a means of attachment of the orifice to an exit port of a vortex tube, said vortex tube connectable to the external air source.

In one preferred embodiment, the diffuser layer is in the form of a vest, but the diffuser layer may alternatively be coterminous with the outer torso covering layer or extended from the orifice into any portion of the outer torso covering layer in which temperature control is desired. The garment may also comprise a hood piece, preferably with an extension of the diffuser layer attached to the interior of the hood piece.

Preferably the outer torso covering layer comprises a substantially impermeable substance (0–5 scfm air permeability) such as Tyvek® Type 14. The diffuser layer is preferably a diffuser material (air permeability of 40 to 500 scfm) such as Tyvek® Type 16.

DETAILED DESCRIPTION OF THE INVENTION AND PREFERRED EMBODIMENTS THEREOF

Figure 1:
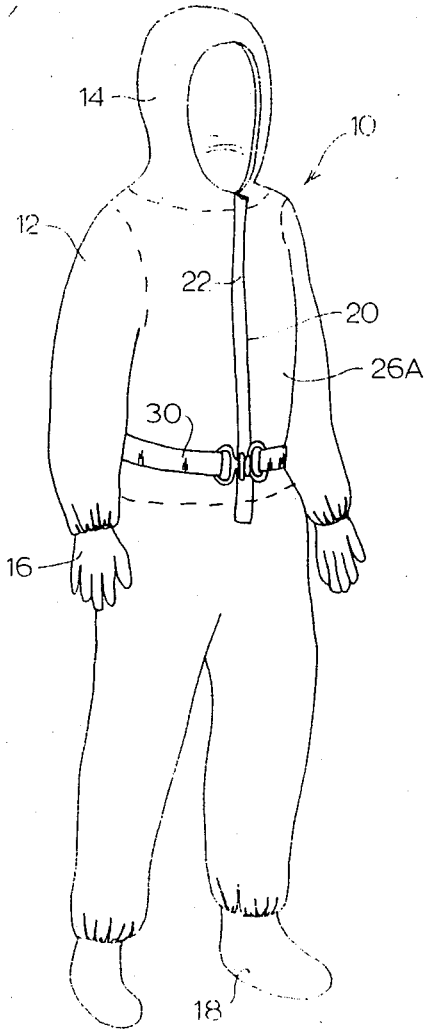
FIG. 1 is a perspective front view of a protective garment according to the invention.
Figure 2:
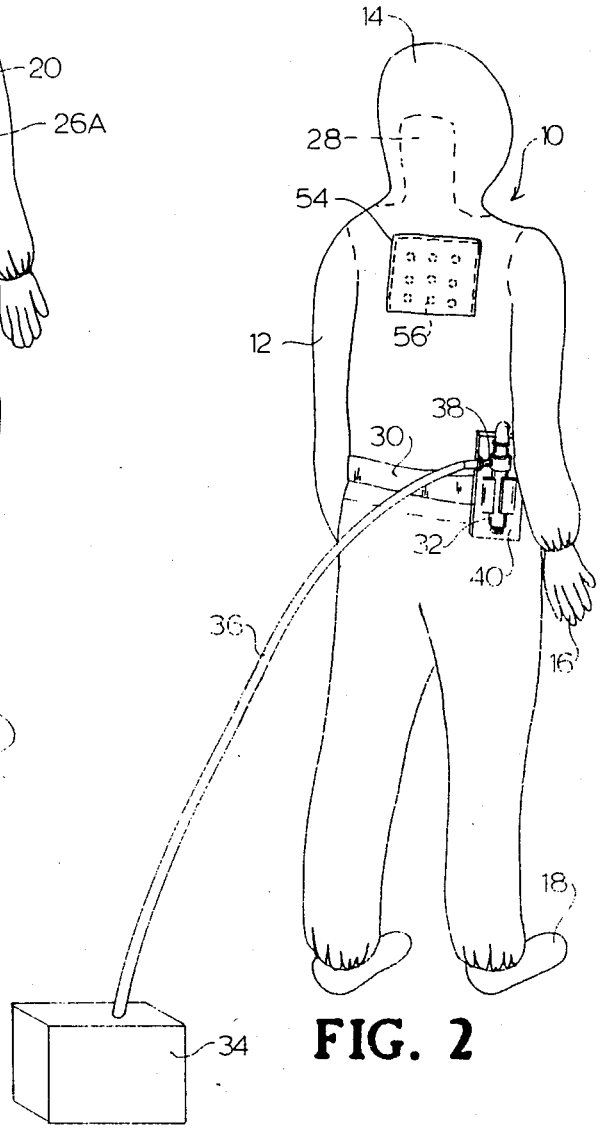
FIG. 2 is a perspective back view of a protective garment according to the invention.
Figure 7:
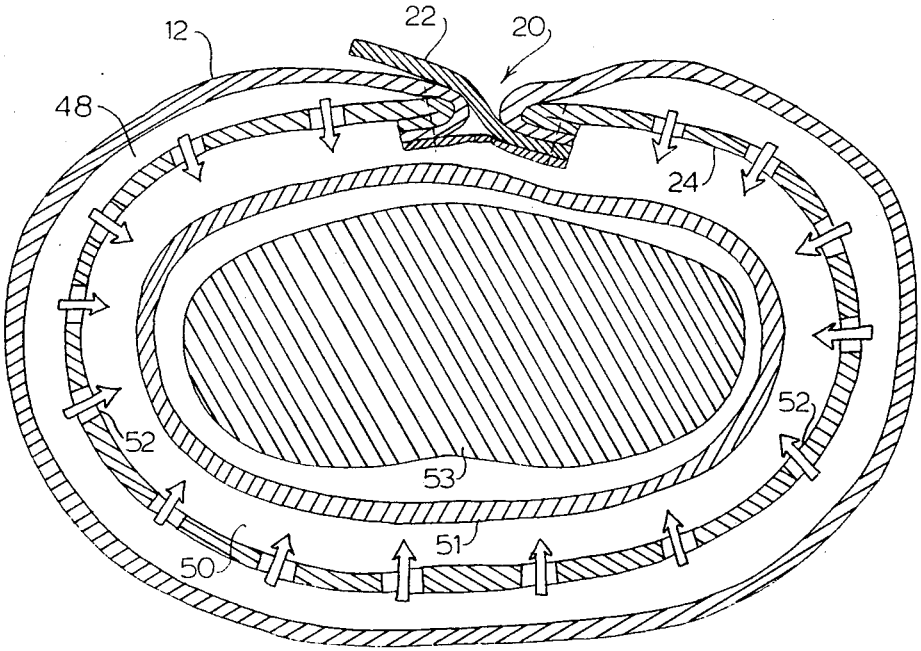
FIG. 7 is a horizontal cross-sectional view of the torso of a person wearing a protective garment according to the invention.

The invention comprises a protective garment 10 for receiving temperature-regulated air from an external air source. The garment 10 includes an outer protective layer 12 that preferably covers the torso and extends down the extremities to the wrists and ankles (FIGS. 1 and 2). A hood 14 is also preferably included for more complete worker protection. Glove elements 16 and foot coverings 18 may be separate from the garment, attached to the garment or integral with the garment as is useful or convenient in the particular application. A zippered or other opening 20 that may be shielded or otherwise made in a worker-protective, relatively air impermeable manner such as with a storm flap or protective flap 22, preferably at the central front of the garment (FIGS. 1 and 7).

The outer torso covering layer 12 of the suit preferably has low air permeability as is typical for many protective garments. The air permeability of fabrics used in protective garments is very important. The lower the air permeability of the protective garment 10, the greater the protection of the wearer from hazardous substances, but the greater discomfort of the wearer under hot conditions or during even moderate exertion. A standard way to determine air permeability of textile fabrics is by the Frazier air permeability calibrated orifice method in which the air permeability is expressed as cubic feet of air per minute per square foot of fabric (scfm). (ASTM Method No. D 737-75). The preferred air permeability for many protective garments as well as for the outer layer of the garment of the invention is 0 to 5 scfm.

Examples of materials that may be used for the outer layer 12 include Tyvek® Type 14 (for example, Tyvek 1422A) that has an air permeability of less than 1 scfm, polyethylene coated Tyvek® materials or coated nonwoven materials such as polyethylene, polypropylene, polyester, nylon rayon, and composites. Low air permeability coatings for the material of the outer covering layer also include Saranex® barrier film (Dow Chemical Chemical Co., Midland, MI) that may be joined with Tyvek® in a multilayer laminant, Teflon, Viton and butyl rubber. Any other impervious barrier system that may be formed into a garment may also be used. The garment seams (not shown) may be made with conventional means, such as stitching with polyester-cotton spun yarn sewing thread utilizing a safety stitch or by other seam attachment means. The positive air pressure inside the outer layer (see below) does not allow air or airborne materials to enter holes that may be formed in the outer layer by the stitching.

Figure 3:
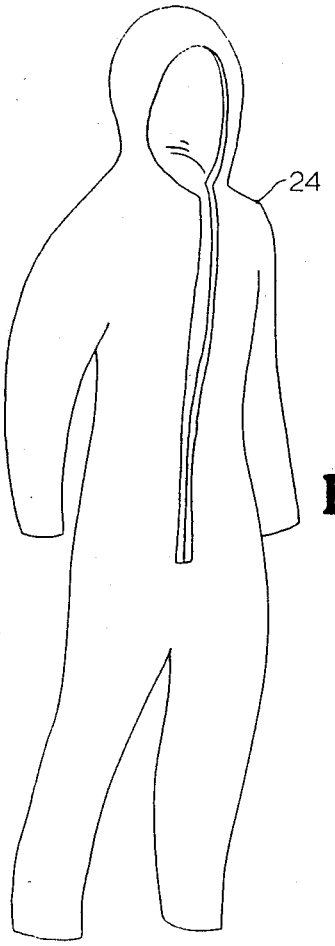
FIG. 3 is a perspective view of a diffuser layer that is of a size to be coterminous with the outer layer.
Figure 4:
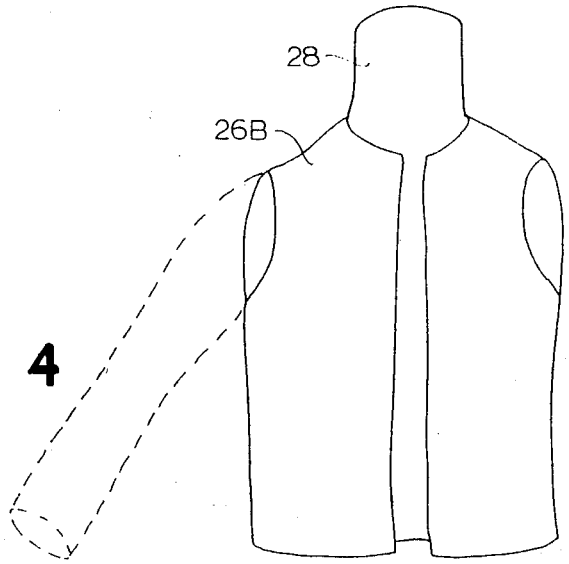
FIG. 4 is a perspective view of a diffuser layer having a vest shape according to the invention.

Attached to the inside of the upper torso area of the garment 10 is a diffuser layer 24 (FIGS 3–4). The diffuser layer 24 may have a body, arms, legs and hood as shown in FIG. 3 so that the diffuser layer 24 and the outer layer 12 are coterminous when attached together. Smaller diffuser layers may omit any or all of the extremity portions. Thus, for example, in another preferred embodiment shown in FIG. 4, the diffuser layer may be a vest shape 26A,B. The vest shape 26A may extend in a cylindrical shape from the underarm area down to just below the waist area and around the wearer's torso (FIG. 1). Alternatively, the vest shape 26B may extend to the top of the shoulder and be provided with arm holes as in a traditional vest garment (FIGS. 2 and 4) or have arms (shown in dotted lines in FIG. 4). The diffuser layer 24 opens at the same area as the outer layer 12, preferably the front of the garment 10. The edges of the diffuser layer of any shape are attached to the outer layer 12 at the garment at all the edges of the diffuser layer 24.

A first preferred means of attachment of the edges of the diffuser layer 24 to the outer layer 12 is by sewing. A second preferred means of attachment of the diffuser layer to the outer layer utilizes, for example, a hot melt coated Saranex® (Bemis Tape Style 6302, Bemis Company, Inc., Minneapolis, MN) applied with a hot melt tape applicator such as the Tex-mac Queen-lite machine, which feeds the tape off a reel and has a hot air application means (Texmac, Inc., Charlotte, NC). Other durable means of attachment may also be used such as ultrasonic bonding or joining with barrier sensitive pressure tape.

In the most preferred embodiment, the diffuser layer 24 also comprises a neck extension member 28 at the back neck area of the diffuser layer 24 that extends into the hood area 14. Alternatively, the diffuser layer 24 may line the entire hood (FIG. 3).

The diffuser layer 24 is preferably made of fabric or other material having an air permeability in the range of about 40 to 500 scfm ("diffuser material"). A preferred fabric in the lower permeability range is porous Tyvek® Type 16 (E.I. DuPont de Nemours & Co., Wilmington, DE), a spun-bonded olefin sheet of high density polyethylene fibers that is pin-hole perforated. Tyvek 16 has an air permeability of 45 scfm, comparable to the permeability of shirting fabrics. A more permeable diffuser layer 24 may be made of Poly-Bond®, a spun-bonded nonwoven fabric (1.2 oz per square yard) made by Wayne-Tex Corporation (Waynesboro, VA) that has an air permeability of 345 scfm. Porosities greater than 500 scfm allow the cool air to flow through with minimal resistance and therefore do not enable the desirable positive pressure to build up (see below) within the area enclosed by the diffuser layer 24 and the outer garment layer.

Figure 5:
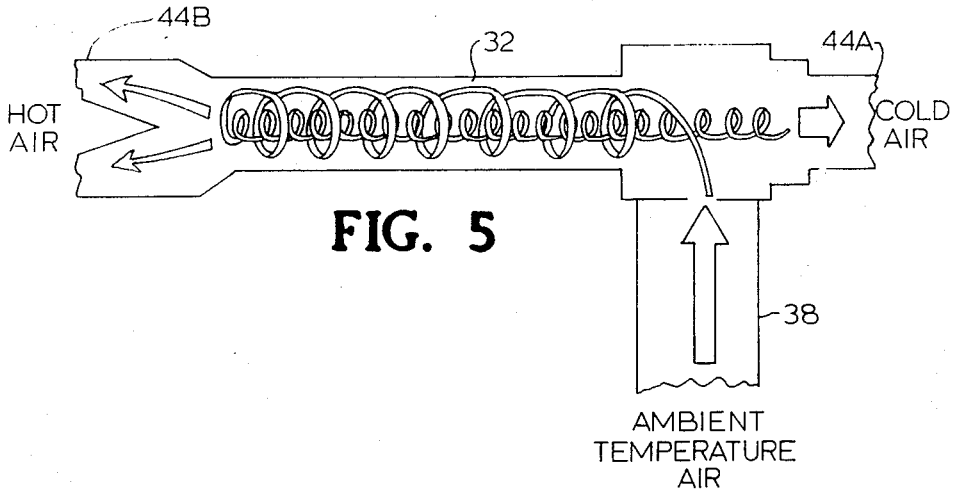
FIG. 5 is a schematic drawing of a vortex tube used with the garment according to the invention.

A person wearing the protective garment 10 of the invention wears a belt 30 and may wear an additional shoulder strap (not shown). A vortex tube 32 (FIGS. 5 and 6) is connected to an air compressor air source 34 by a tube 36 at the air entry port 38 of the vortex tube 32. The vortex tube 32 is preferably held to the belt 30 by a bracket that is made for that purpose (not shown) and that is attached to the vortex tubes sold by the Vortec company. A heat shield 40, such as that sold with Vortec vortex tubes insulates the wearer from hot air emitted from the vortex tube 32. The belt 30 must be strong enough to carry the weight of a vortex tube 32 and be designed to hold the vortex tube 32 from being pulled off the belt 30 by the movement of the worker relative to the source of the air.

Figure 6:
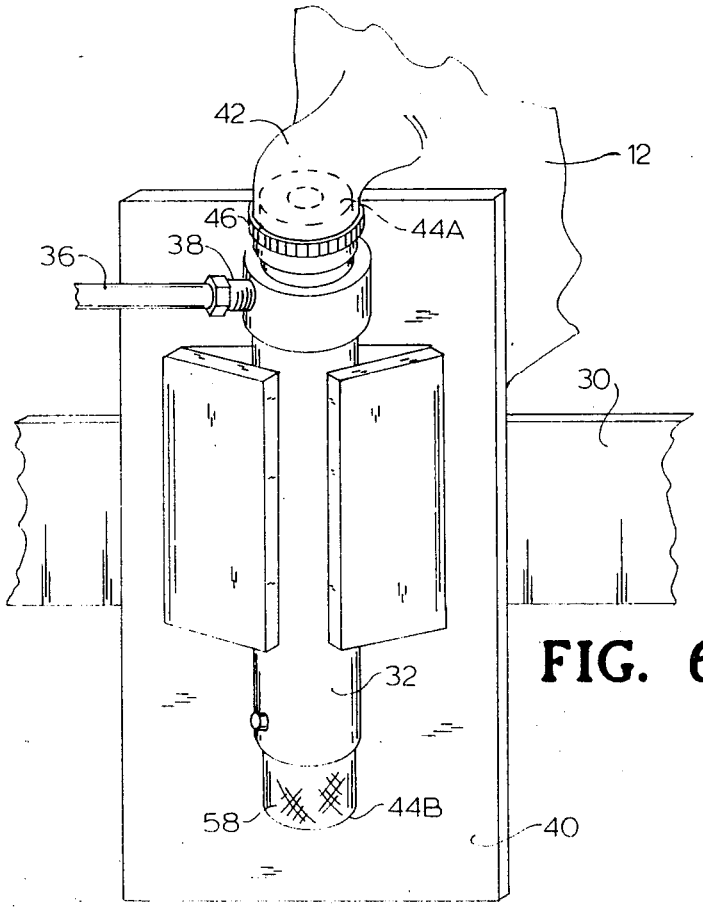
FIG. 6 is a perspective view of a garment orifice and its connection to the vortex tube of FIG. 5.

The outer layer 12 of the protective garment 10 has an orifice 42 preferably at the waist area, for attachment to the garment 10 of the selected outlet end 44A,B of the vortex tube 32 (FIG. 6). The orifice 42 is preferably a tubular extension of the outer layer and made of the same material as the outer layer. To further secure the vortex tube 32 to the garment 10 and orifice 42, a clamping means 46 such as a hose clamp or other attachment means may be placed around the orifice and the inserted outlet end of the vortex tube 32. When the garment 10 of the invention is worn under cooling conditions (connection to the cooling outlet end 44A), cooled air from the vortex tube 32 enters the orifice 42 under positive pressure.

As the air spreads away from the orifice 42, the portion of it that passes through the air permeable diffuser layer 24 from the cavity 48 between the diffuser layer 24 and the outer layer 12 into the body surrounding area 50 outside of the wearer's clothing 51 and body 53 depends on the size of the pores 52 in the diffuser layer 24 and on the air pressure of the cooled air (FIG. 7). In the embodiment of the invention with a neck extension 28, air also travels into the neck extension 28 and exits through the pores in the diffuser fabric of the neck extension 28.

The flow of the air within the garment cavity 48 may be controlled and defined by quilting the diffuser layer 24 to the outer garment layer 12 or otherwise constructing air baffles and/or pathways within the air space (not shown). Air also leaks out of the seam areas into the body surrounding area 50 because of the positive pressure within the cavity 48. Air escaping from the diffuser area of a vest-shaped garment also moves into the sleeve and pant leg areas. Air escapes at the wrists and ankles as well as from the hood around the face. This movement of the air under positive pressure tends to keep hazardous chemicals from entering the garment and to sweep any hazardous material out of the garment that may have entered.

If the diffuser layer 24 is coterminous with the outer layer 12 or if greater air flow through the cavity is desired, an air escape valve may be added to the outer layer 12 to augment air movement out of the cavity. For example, the air escape valve may comprise a flap 54 sewn around the top and two sides to the outer layer placed over a section of the outer garment having large holes 56 (FIG. 2), or the air escape valve may be a cracking pressure escape valve.

The invention may be used advantageously by persons engaged in a wide variety of tasks in which an outer protective garment is required and cooling of the worker is necessary due to the hot working conditions or the strenuous nature of the work. This includes but is not limited to agricultural workers who handle agricultural chemicals (pesticides, fertilizers, etc.), workers engaged in hazardous chemical monitoring or cleanup operations, and persons who must handle hazardous substances in their research or development activities. Persons who work in asbestos cleanup areas may be particularly aided by this invention because of the typically hot and difficult working conditions under which asbestos must be removed, such as in schools in the summer time. Pharmaceutical workers, who dilute, filter, dispense and otherwise handle chemicals such as estrogens and hormones and now wear protective garments with uncooled air provided from compressors could also be cooled by use of the protective garment of the invention.

Workers who remain relatively stationary may utilize an air compressor as an air source, having a length of hose as normally used with protective suit ventilation systems, that extends from the compressor to the worker and is attached to the vortex tube of the invention at the connector. Air compressors to be used with the invention must be able to deliver at least 70 psi (preferably 70–100 psi) to the protective suit. For example, to deliver 7 cfm at 90 psi, a 5 HP single stage compressor or a two-stage compressor would be useful.

The vortex tube used with the invention must be connectable to an air compressor and designed to meet the relevant NIOSH standards. For example, the invention may be utilized with vortex tubes from Vortec Corporation (Cincinnati, OH) that are utilized with the Vortec Respirator System. These vortex tubes, for example Model 24815, work at an operating pressure of 70–100 psig, with an air flow to the garment of 6–15 scfm and a total air consumption of 15 scfm at 100 psig. Temperature from the vortex tube is regulated by turning a knob 58 that adjusts the air flow rate (FIG. 6). Even a small, relatively inexpensive vortex tube such as the Model 24815 is effective with the garment of this invention.

Persons engaged in activities requiring them to change work locations, may need longer lengths of hose connecting them to the source of compressed air and/or may require a mobile source of compressed air. Thus, in a preferred method of connection of the invention to an air source for agricultural workers applying pesticides in the field, the invention may have an adaptor for connecting the vortex tube to the air compressor of a tractor having such a compressor. Thus, the drive shaft of a compressor may be connected to a gear reduction system of a tractor, for example, as appropriate for the speed of the compressor. The same air compressor found on tractors having air conditioned cabs may also be used as a source of compressed air for the invention, the air-conditioned cab itself no longer being necessary. A standard pressure reduction valve enables the output from the compressor to be adjusted to the requisite 70–100 psi to meet NIOSH requirements. Alternatively, the appropriate compressor may be mounted on a mobile unit or vehicle.

Air used in the invention does not need to be of breathable quality because separate respirators may be worn for work with volatile and/or airborne hazardous chemicals. Alternatively, it may be desirable to use breathable air in the invention and to employ a frontal face shield on the hood of the garment in a manner known in the art (not shown).

The garment of the invention may also be used for keeping a worker warm in severely cold environments as well as for cooling a worker. This is accomplished by attaching the hot air exit 44B of the vortex tube 34 to the orifice 42 on the garment 10 instead of the cold air exit 42A, and by adjusting the temperature controls appropriately.

While the invention has been described with reference to specific embodiments thereof, it will be appreciated that numerous variations, modifications, and embodiments are possible, and accordingly, all such variations, modifications, and embodiments are to be regarded as being within the spirit and scope of the invention.

What is claimed is:

1. A garment for receiving temperature-regulated air from an external air source, comprising:

(a) an outer impermeable, protective torso covering layer having an interior surface, an exterior surface, a neck area, a waist area and an orifice;

(b) a single diffuser layer having peripheral edges, said edges attached to the interior surface of said outer covering layer, said diffuser layer extending around a wearer's torso and coextensive with the outer covering layer at least from approximately the shoulder regions to the waist area, said diffuser layer being made of a diffuser material; and (c) a means of attachment of the orifice to an exit port of a vortex tube, said vortex tube connectable to the external air source.

2. A garment for receiving temperature regulated air according to claim 1, further comprising a hood piece attached to the garment outer torso covering and forming a garment hood area.

3. A garment for receiving temperature-regulated air according to claim 2, wherein the diffuser layer comprises a neck extension, said neck extension attached to the interior surface of said hood piece, the attachment of said neck extension to said hood piece forming a means for entry of temperature-regulated air from the external air source into the garment hood area.

4. A garment for receiving temperature-regulated air according to claim 1, wherein the outer torso covering comprises a substantially impermeable substance.

5. A garment for receiving temperature-regulated air according to claim 4, wherein the substantially impermeable substance comprises Tyvek® Type 14.

6. A garment for receiving temperature-regulated air according to claim 1, wherein the diffuser material comprises Tyvek® Type 16.

7. A garment for receiving temperature-regulated air according to claim 1, further comprising a belt means to hold the vortex tube near the waist area of the garment.

8. A garment for receiving temperature-regulated air according to claim 1, wherein the orifice comprises a tubular external extension of the outer layer and the means of attachment of the orifice to the exit port of the vortex tube comprises placement of the exit port within the orifice.

9. A garment for receiving temperature-regulated air according to claim 1, wherein the external air source is a compressor on a vehicle.

10. A garment for receiving temperature-regulated air according to claim 1, wherein the diffuser layer is coterminus with the outer torso covering layer.

11. A garment for receiving temperature-regulated air according to claim 1, wherein the diffuser layer is vest-shaped.

12. A garment for receiving temperature-regulated air according to claim 1, further comprising an air escape valve in the outer covering layer.

* * * * *